US006016762A

United States Patent [19]

Price

[11] Patent Number: 6,016,762

[45] Date of Patent: Jan. 25, 2000

[54] PLANING FOIL FOR TWIN HULLED BOATS

[76] Inventor: Leroy Price, 25500 S. 624 Loop, Grove, Okla. 74344

[21] Appl. No.: 09/044,652

[22] Filed: Mar. 19, 1998

[51] Int. Cl.[7] ..... B63B 1/24

[52] U.S. Cl. ..... 114/274; 114/61.22; 114/283

[58] Field of Search ..... 114/61.1, 61.22, 114/61.24, 271, 274, 283, 292

[56] References Cited

U.S. PATENT DOCUMENTS

| | | | |
|---|---|---|---|
| D. 267,866 | 2/1983 | Parsons . | |
| 2,794,192 | 6/1957 | Paris . | |
| 2,950,699 | 8/1960 | Ogden et al. . | |
| 3,019,755 | 2/1962 | Diamond . | |
| 3,345,967 | 10/1967 | Sweet . | |
| 3,547,062 | 12/1970 | Rainu | 114/292 |
| 3,604,384 | 9/1971 | Coles . | |
| 4,378,747 | 4/1983 | Beatty et al. . | |
| 4,528,927 | 7/1985 | Iizuka et al. . | |
| 4,665,853 | 5/1987 | Gerdsen et al. . | |
| 4,993,340 | 2/1991 | Pepper . | |
| 5,184,561 | 2/1993 | Nickell, Jr. . | |
| 5,259,331 | 11/1993 | Hagan | 114/61.1 |

*Primary Examiner*—Sherman Basinger
*Attorney, Agent, or Firm*—Hovey, Williams, Timmons & Collins

[57] ABSTRACT

A preferred planing foil apparatus (10) for use with a pontoon boat (12) includes mounting structure (32) for connecting a planing foil (30) to the boat (12) with the foil (30) positioned between and spaced from the pontoons (12, 14) generally amidships and straddling the transverse centerline of the boat (12). The foil (30) is also positioned between the waterline (62) and the lower surfaces (64) of the pontoons (12, 14) when the boat (12) is at rest so that foil (30) rises toward a planing position on the surface of the water as the boat (12) is propelled therealong in order to lift the boat (12) and reduce drag.

13 Claims, 2 Drawing Sheets

10
30
32
34
36
38
40
42
44
46
48
50
52
54
54a
54b
54c
54d
54e
56a
56b
58
60
62
64
66
5
5

PLANING FOIL FOR TWIN HULLED BOATS

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention relates to the field of increasing boat performance by reducing drag. More particularly, the invention is concerned with a preferred planing foil apparatus for use with a pontoon boat including mounting structure for connecting a planing foil to the boat with the foil positioned between and spaced from the pontoons generally amidships and straddling the transverse centerline of the boat. The foil is also positioned between the waterline and the lower surfaces of the pontoons when the boat is at rest so that foil rises toward a planing position on the surface of the water as the boat is propelled therealong in order to lift the boat and reduce drag.

2. Description of the Prior Art

The prior art discloses devices for reducing drag such as hydrofoils designed to lift the hull of the boat entirely out of the water for high speed travel. Such are impractical for a recreational pontoon boat. Other prior art devices are designed for specific purposes such as improving boat stability during a turn. None of the prior art provides a practical and economical device to improve pontoon boat performance by reducing pontoon drag at various speeds.

SUMMARY OF THE INVENTION

The present invention solves the prior art problems discussed above and provides a distinct advance in the state of the art. In particular, the planing foil hereof provides a practical and economical way to improve pontoon boat performance by reducing drag.

The preferred planing foil apparatus for use with a pontoon boat includes a planing foil and mounting structure for positioning the foil between and spaced from the pontoons generally amidships and straddling the transverse centerline of a boat. The preferred mounting structure also positions the foil between the waterline and the lower surfaces of the pontoons when the boat is at rest so that the foil rises toward a planing position on the surface of the water as the boat is propelled therealong in order to lift the boat and reduce drag. Other preferred aspects of the present invention are disclosed herein.

DETAILED DESCRIPTION OF THE PREFERRED EMBODIMENT

Figure 1:
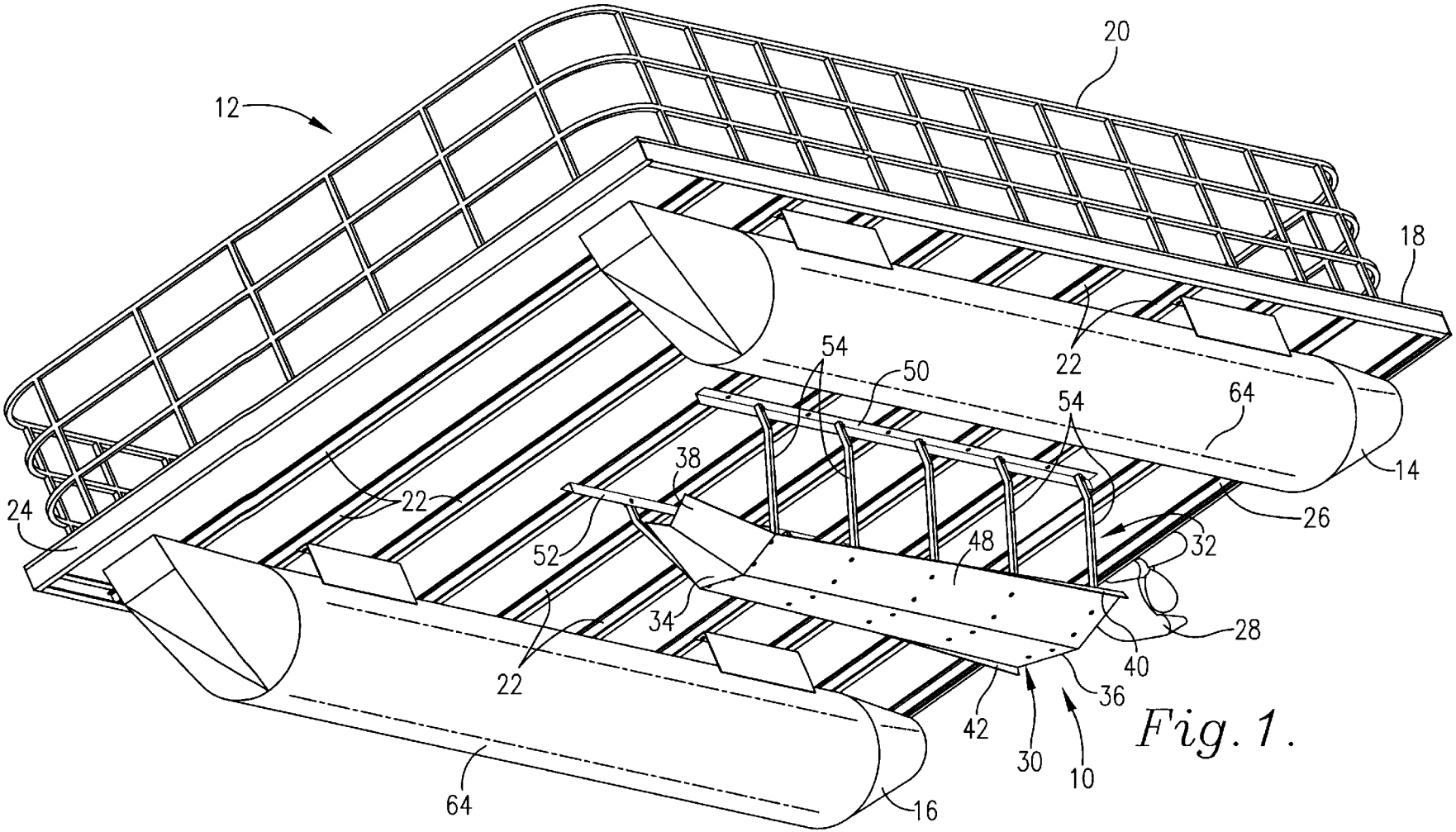
FIG. 1 is a bottom, front, left pictorial view of the preferred planing foil apparatus in accordance with the present invention shown mounted to a pontoon boat.

FIG. 1 illustrates preferred planing foil apparatus 10 in accordance with the present invention. As shown, apparatus 10 is mounted to conventional pontoon boat 12.

Boat 12 includes spaced, generally parallel, left and right pontoons 14 and 16, deck 18 interconnecting and spanning the upper surfaces of pontoons 14, 16, and upstanding guard railing 20 circumscribing deck 18. As shown, deck 18 includes a plurality of transverse deck supports 22. Boat 12 also presents bow 24 and stern 26 with a portion of outboard motor 28 shown adjacent stern 26.

Figures 2, 3, 4, 5, 6, 7:
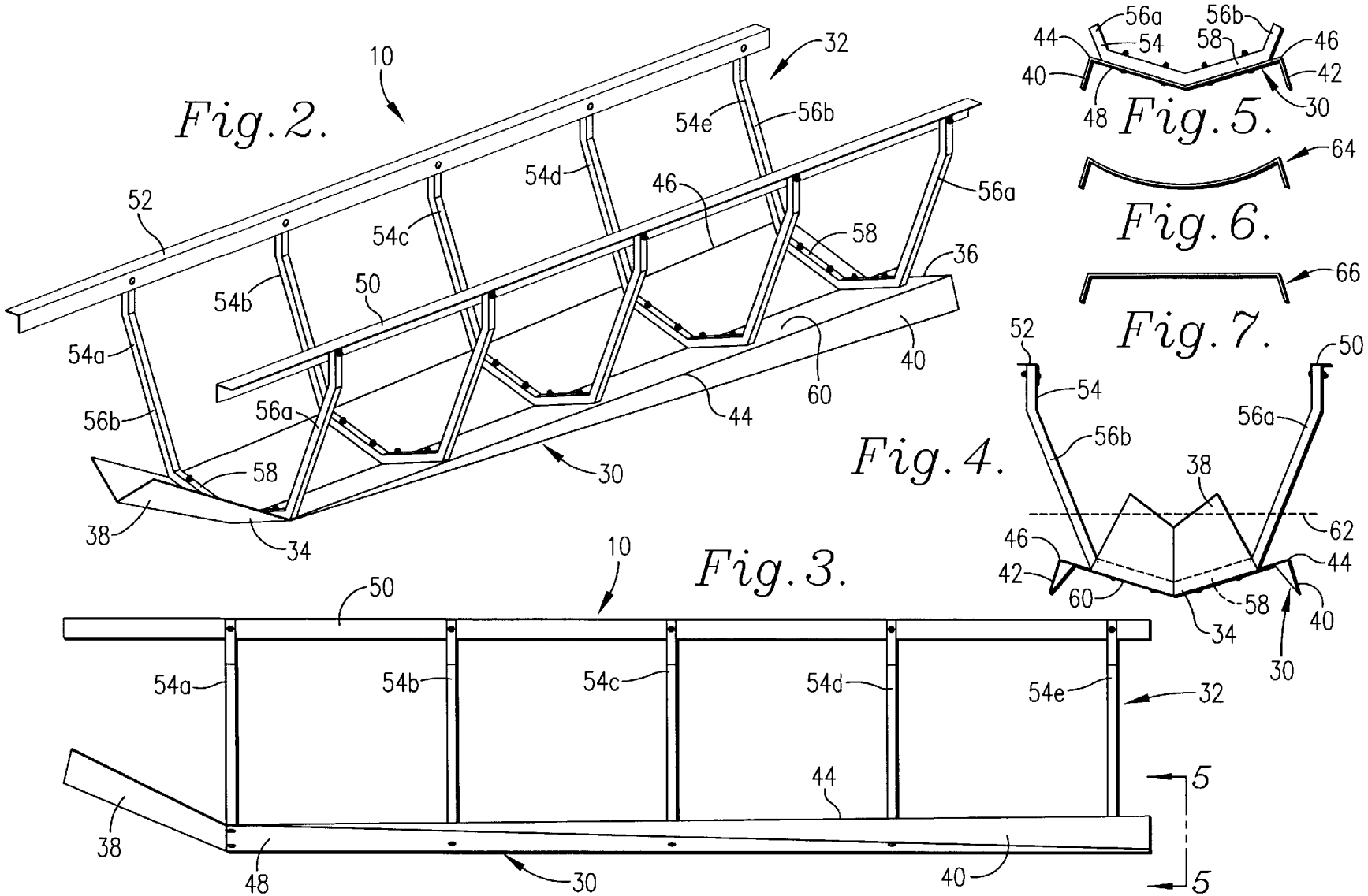
FIG. 2 is a top, front, left pictorial view of the apparatus of FIG. 1.
FIG. 3 is a left elevational view of the apparatus of FIG. 1.
FIG. 4 is a front elevational view of the apparatus of FIG. 1 shown in relation to the waterline when mounted to the boat at rest in the water.
FIG. 5 is a rear elevational view along line 5—5 of FIG. 3.
FIG. 6 is a rear elevational view of a second embodiment of the apparatus of FIG. 1.
FIG. 7 is a rear elevational view of a third embodiment of the apparatus of FIG. 1.

Referring also to FIGS. 2–5, planing foil apparatus 10 includes planing foil 30 and mounting structure 32. Foil 30 is between ten and twelve feet long and, as shown in FIG. 5, presents a generally, shallow V-shaped configuration in transverse section. Foil 30 gradually widens from about 18" wide or wider at the forward end 34 to about 24" wide or wider at the rearward end 36.

Foil 30 also includes up-turned forward section 38 extending from forward end 34 and further includes left and right, anti-splash skirts 40 and 42 extending outwardly and downwardly from opposed side edges 44 and 46 respectively. As best viewed in FIG. 2, skirts 40, 42 also widen gradually from forward end 34 to about 3" wide at rearward end 36. Foil 30 is preferably integral in construction, composed of ⅛" thick aluminum sheet metal and presents lower planing face 48.

Mounting structure 32 connects foil 30 with deck supports 22 of boat 14 in depending relationship therewith. Mounting structure 32 includes left and right, mounting rails 50 and 52 in the nature of 2" aluminum angles and includes five, spaced structural ribs 54 (individually designated 54*a*, 54*b*, 54*c*, 54*d*, and 54*e*). As best viewed in FIG. 1, rails 50, 52 are bolted to the underside of deck supports 22 in a spaced, generally parallel relationship on opposed sides of the centerline of boat 12.

Each rib 54 is integrally formed of bent, 11 gage, 1" square aluminum tubing and includes a pair of spaced stringers 56*a* and 56*b* and transverse member 58. The upper ends of stringers 56*a,b* are configured for bolting with a respective rail 50, 52 so that stringers 56*a,b* depend therefrom.

Transverse member 58 interconnects the opposed ends of stringers 56*a,b* as best viewed in FIGS. 2 and 4. As illustrated, each transverse member 58 is configured to connect by bolting to foil 30 at upper face 60 and conform generally to the shape thereof. In this way, transverse members 58 reinforce the shape and structural integrity of foil 30. It will be noted from FIG. 2 that transverse members 58 of ribs 54*a*–*e* are successively longer in order to span the successively wider portions of foil 30. If needed, the various structural members can include slotted holes so that the positions of the attachment bolts can be adjusted to change the orientation of planing face 48 as needed for optimal performance.

As illustrated in FIG. 1, mounting structure 32 positions foil 30 and planing face 48 between and spaced from pontoons 14, 16 with the longitudinal centerline of face 48 generally aligned amidships and straddling the transverse centerline of boat 12. In this position, foil forward end 34 is spaced inwardly from bow 24 and foil rearward end 36 is spaced inwardly from stern 26. Moreover, mounting structure 32 positions planing face 48 between the waterline 62 (see FIG. 4) and the lower surfaces 64 of pontoons 14, 16 when boat 12 is in the water at rest.

In use, as motor 28 propels boat 12, the configuration of planing face 48 causes face 48 to rise toward a planing position on the surface of the water. This is aided by the upturned configuration of forward section 38. As the speed of boat 12 increases, face 48 continues to rise until achieving the planing position on the surface. In so doing, face 48 lifts boat 12 by way of mounting structure 32 and in particular, lifts pontoons 14, 16, thereby reducing the drag presented by pontoons 14, 16. That is, pontoons 14, 16 remain in the water but present a shallower draft because of the lift provided by planing face 48 thereby reducing the drag of the pontoons.

With less drag, boat 12 achieves a higher speed with the same horsepower motor. This also means greater fuel efficiency at a given speed.

Reduced drag is also achieved at speeds lower than that required for planing face 48 to reach the planing position on the surface of the water. At even low speeds, face 48 provides some lift to pontoons 14, 16 thereby reducing the drag and providing the benefits of greater fuel efficiency.

FIG. 6 illustrates another embodiment 66 of the present invention. This embodiment is the same as FIGS. 1–5 except for the shape of foil 30. In particular, FIG. 6 illustrates a concavo-convex configuration of foil 30 in transverse section. Similarly, FIG. 7 illustrates embodiment 68 showing a planar configuration of foil 30 in transverse section. This illustrates that the present invention includes various shapes for foil 30 as needed for particular applications.

Those skilled in the art will appreciate that the present invention encompasses many other variations in the preferred embodiments described herein. For example, a wide variety of materials can be used other than the preferred aluminum such as steel, fiberglass, composites and synthetic resin material. As another example, mounting structure 32 can present other structural shapes such as a planar board or T-bar. Also, the various structures can be interconnected with rivets, screws or by welding. Having thus described the preferred embodiment of the present invention, the following is claimed as new and desired to be secured by Letters Patent:

I claim:

1. A planing foil apparatus for use with a pontoon boat having a pair of spaced pontoons and a deck therebetween supported by deck supports, said apparatus comprising:

a planing foil having a lower planing face presenting a longitudinal center line; and mounting structure including a plurality of spaced structural ribs reinforcing said planing foil including structure for connecting said foil with the deck supports of the boat in depending relationship therewith, for positioning said planing face between and spaced from the pontoons with said longitudinal center line generally aligned amidships and straddling the transverse center line of the boat, and for positioning said planing face between the waterline and the lower surfaces of the pontoons when the boat is in the water at rest, said planing face being configured for rising toward a planing position on the surface of the water as the boat is propelled therealong and for lifting the boat and the pontoons as a whole in order to reduce drag.

2. The apparatus as set forth in claim 1, said planing foil presenting a generally planar configuration in transverse section.

3. The apparatus as set forth in claim 1, said planing foil presenting a generally V-shaped configuration in transverse section.

4. The apparatus as set forth in claim 1, said planing foil presenting a generally concavo-convex configuration in transverse section.

5. The apparatus as set forth in claim 1, said planing foil presenting opposed side edges and including a pair of spaced, anti-splash skirts extending downwardly and outwardly respectively from said opposed side edges.

6. The apparatus as set forth in claim 1, said planing foil including an upturned forward portion.

7. The apparatus as set forth in claim 1, each of said structural ribs each including a pair of spaced stringers having connection ends thereof configured for connecting with the deck supports of the boat and a transverse member extending between the opposed ends of the stringers and connected to the planing foil.

8. The apparatus as set forth in claim 7, said stringers being composed of square tubular aluminum.

9. The apparatus as set forth in claim 1, said planing foil being composed of aluminum.

10. The apparatus as set forth in claim 1, said planing foil presenting a forward end and rearward end and gradually increasing in width from said forward end to said rearward end.

11. The apparatus as set forth in claim 1, said planing foil presenting a forward end and a rearward end and being configured so that, when said apparatus is connected to the boat, said forward end is spaced from the bow of the boat and said rearward end is spaced from the stern of the boat.

12. A planing foil apparatus for use with a pontoon boat having a pair of spaced pontoons and a deck therebetween supported by deck supports, said apparatus comprising:

a planing foil having a lower planing face presenting a longitudinal center line, said planing foil presenting a forward end and a rearward end and increasing gradually in width from said forward end to said rearward end, said planing foil presenting opposed side edges and including anti-splash skirts extending outwardly and downwardly respectively from said side edges, said planing foil including an upturned section adjacent said forward end; and mounting structure including a plurality of spaced structural ribs reinforcing said planing foil, each of said structural ribs each including a pair of spaced stringers having connection ends thereof configured for connecting with the deck supports of the boat and a transverse member extending between the opposed ends of the stringers and connected to the planing foil, said mounting structure being configured for connecting said foil with the deck supports of the boat in depending relationship therewith, for positioning said planing face between and spaced from the pontoons with said longitudinal center line generally aligned amidships and straddling the transverse center line of the boat, for positioning said forward end spaced inwardly from the bow of the boat and said rearward end spaced inwardly from the stern of the boat, and for positioning said planing face between the waterline and the lower surfaces of the pontoons when the boat is in the water at rest, said planing face being configured for rising toward a planing position on the surface of the water as the boat is propelled therealong and for lifting the boat and the pontoons as a whole in order to reduce drag.

13. In combination:

a pontoon boat having a pair of spaced pontoons and a deck therebetween supported by deck supports; and a planing foil apparatus including a planing foil having a lower planing face presenting a longitudinal center line, said planing foil presenting a forward end and a rearward end and increasing gradually in width from said forward end to said rearward end, said planing foil presenting opposed side edges and including anti-splash skirts extending outwardly and downwardly respectively from said side edges, said planing foil including an upturned section adjacent said forward end, and mounting structure including a plurality of spaced structural ribs reinforcing said planing foil, each of said structural ribs each including a pair of spaced stringers having connection ends thereof configured for connecting with the deck supports of the boat and a transverse member extending between the opposed ends of the stringers and connected to the planing foil, said mounting structure being configured for connecting said foil with the deck supports of the boat in depending relationship therewith, for positioning said planing face between and spaced from the pontoons with said longitudinal center line generally aligned amidships and straddling the transverse center line of the boat, for positioning said forward end spaced from the bow of the boat and said rearward end spaced from the stern of the boat, and for positioning said planing face between the waterline and the lower surfaces of the pontoons when the boat is in the water at rest, said planing face being configured in a shallow V for rising toward a planing position on the surface of the water as the boat is propelled therealong and for lifting the boat and the pontoons as a whole in order to reduce drag.

* * * * *